US005308252A

United States Patent [19]

Mroczkowski et al.

[11] Patent Number: 5,308,252

[45] Date of Patent: May 3, 1994

[54] INTERPOSER CONNECTOR AND CONTACT ELEMENT THEREFORE

[75] Inventors: Robert S. Mroczkowski, Lititz; Richard E. Rothenberger, Harrisburg, both of Pa.

[73] Assignee: The Whitaker Corporation, Wilmington, Del.

[21] Appl. No.: 996,751

[22] Filed: Dec. 24, 1992

[51] Int. Cl.[5] ..... H01R 9/09

[52] U.S. Cl. ..... 439/66; 439/591

[58] Field of Search ..... 439/66, 71, 81, 82, 439/591

[56] References Cited

U.S. PATENT DOCUMENTS

| | | | |
|---|---|---|---|
| 4,511,197 | 4/1985 | Grabbe et al. | 339/17 CF |
| 4,513,353 | 4/1985 | Bakermans et al. | 361/399 |
| 4,647,124 | 3/1987 | Kandybowski | 339/17 CF |
| 4,699,593 | 10/1987 | Grabbe et al. | 439/71 |
| 4,906,194 | 3/1990 | Grabbe | 439/66 |
| 4,927,369 | 5/1990 | Grabbe et al. | 439/66 |
| 4,969,826 | 11/1990 | Grabbe | 439/66 |
| 4,998,886 | 3/1991 | Werner | 439/66 |
| 5,129,143 | 7/1992 | Wei et al. | 29/885 |
| 5,167,512 | 12/1992 | Walkup | 439/66 |
| 5,190,473 | 3/1993 | Mroczkowski et al. | 439/580 |

OTHER PUBLICATIONS

IBM Tech. Disclosure Bulletin, vol. 6 No. 10, Mar. 1964 439/66, "Plated Through-hole Contact", Schick pp. 5-6.

IBM Tech. Disclosure Bulletin, vol. 17 No. 2 Jul. 1974 "Pin Pad Contacter", Faure et al; 439/66 pp. 444-445.

Rothenberger et al., High-Density Zero Insertion Force Microcoaxial Cable Interconnection Technology, pp. 1-5.

*Primary Examiner*—Paula A. Bradley

*Attorney, Agent, or Firm*—Anton P. Ness

[57] ABSTRACT

Electrical contacts adapted to electrically mate with two electronic components having high cycle life. The contacts comprise a first interface means for electrically mating with a planar mating face of a first such electronic component and a second interface means for electrically mating with, a planar face of a second such electronic component. The contacts also preferably comprise connecting means for resiliently connecting said first and second interface means and mating resistance means for providing a first amount of mating resistance to said first interface means and a second amount of mating resistance to said second interface means.

30 Claims, 12 Drawing Sheets

INTERPOSER CONNECTOR AND CONTACT ELEMENT THEREFORE

FIELD OF THE INVENTION

This invention relates generally to electrical contacts and more particularly to high cycle-life contacts for land grid arrays.

BACKGROUND OF THE INVENTION

Numerous types and varieties of modern equipment and devices require sophisticated interconnection of electronic components. With the recent strong trend toward reduced sizes in electronic components and the resulting high density of conductive interconnection surfaces on such equipment, there have been increased demands on the performance of contacts used to provide such interconnections.

Modern ultrasound diagnostic equipment provides an example of the types of environments in which the contacts of the present invention may be used. Such equipment typically includes a connector system for interfacing a computer located in a base unit with a transducing device which interfaces with the patient's body. Such connector systems generally comprise an electrical interface which buses the signals from the transducer to the base unit for analysis and data processing. Radar equipment, computer equipment in general, and other electronic devices also frequently have similar interfaces.

As mentioned above, certain applications require sophisticate-d systems for implementing high speed data links from the outside source to the analytic or diagnostic device. In such applications, the connector interfaces can become very complex. To achieve high integrity data communications between the outside source of data and the device, prior connectors have been designed to accommodate high density contacts so that increased data flow through the connector at high frequencies and at high speeds can be achieved. Examples of such connectors and connector systems are found in U.S. Pat. No. 4,699,593, Grabbe et al., and U.S. Pat. No. 4,927,279, Grabbe et al., the teachings of both being specifically incorporated herein by reference.

In the connectors such as those disclosed in the Grabbe et al. patents, two electronic components, such as two printed wiring boards, are interconnected by a system of contacts sometimes referred to as a land grid array. Prior connectors of the type illustrated in the Grabbe et al. patents are frequently "one-shot" connectors in that they are designed to be permanently assembled in mated relationship to the device, and not for repeated mating and connecting at a separable interface.

One technique commonly used for electrically connecting the pads of a first electronic component having closely spaced contact pads to the interfacing surface of a second electronic component is to braze each pad of the first electronic component to the head of an electrical pin, using a gold alloy. The pins are then interfaced with the second electronic component by, for example, being inserted into plated through holes in the second electronic component and soldered to the plating of the holes. Alternatively, the pins may be inserted into sockets which have been soldered into plated through holes. In the first case, it is inconvenient, if not practically impossible, to unmate the two electronic components. In the second case, it is expensive to provide the sockets, which may be low or zero insertion force sockets, and economy of space is not achieved. In any event, the brazing of the pins to the contact pads of the electronic component is both time consuming and expensive. When a high density of contact pads on the electronic components is required, an interposer arrangement has also been used to provide an effective connection medium. Such "interposer" connectors typically comprise an insulating housing or structure having cavities therein for receiving electrical contact elements. Such contact elements have contact surfaces which project from opposite surfaces of the interposer structure. This type of connector is typically used for interposition between the two electronic components, such as two printed wiring boards, so that each contact surface of each contact element engages with a respective pad of the electronic component.

While the contact elements typically used in prior interposer arrangements have enjoyed a certain degree of success, Applicants have nevertheless recognized that certain limitations are associated with contact elements of the type generally previously used, in certain applications. The contact elements shown in U.S. Pat. No. 4,927,369—Grabbe et al., for example, comprise a pair of identical, looped shaped contact springs arranged in mirror image symmetry. These identical springs are connected to one another by a bight portion. In use, the interposer is sandwiched between the two electronic components such that the contact surfaces are moved towards one another as the surfaces of the electronic components mate with the opposing surfaces of the interposer. The spring portions of the contact elements resist such movement and thereby provide a required contact force at the interface between the pad and the contact surface. The contact force exerted by each contact surface on its associated electrical pad is substantially identical. Other single force contact elements are shown, for example, in the following U.S. Pat. Nos.: 4,647,124, Kandybowski; and 4,699,593, Grabbe et al.

Applicants have recognized that it is desirable and advantageous to provide contact elements which provide a first contact force on one side of the interposer and a second contact force on the other side of the interposer.

The ability of contacts, and particularly contacts of the type used in interposer arrangements, to undergo numerous mating and unmating cycles is desirable in that they would allow the same interposer to be used with various devices and/or frequently reused with the same device.

SUMMARY OF THE INVENTION

The foregoing problems are solved and objects achieved by connectors for electrically interfacing contacts to surfaces provided in accordance with the present invention. In preferred embodiments, the electrical contacts hereof are adapted to electrically mate with two electronic components and comprise a first interface means for electrically mating with a first such electronic component and a second interface means for electrically mating with a second such electronic component. The contacts also preferably comprise connecting means for electrically connecting said first and second interface means, and mating resistance means for providing a first amount of mating resistance to said first interface means and a second amount of mating resistance to said second interface means.

Embodiments of the present invention will be described by way of Examples with reference to the accompanying drawings.

BRIEF DESCRIPTION OF THE DRAWINGS

FIG. 13 is a cross-sectional view of an interposer disposed over a printed wiring board with mounting holes aligned to receive fasteners;

DETAILED DESCRIPTION OF PREFERRED EMBODIMENTS

Figure 1:
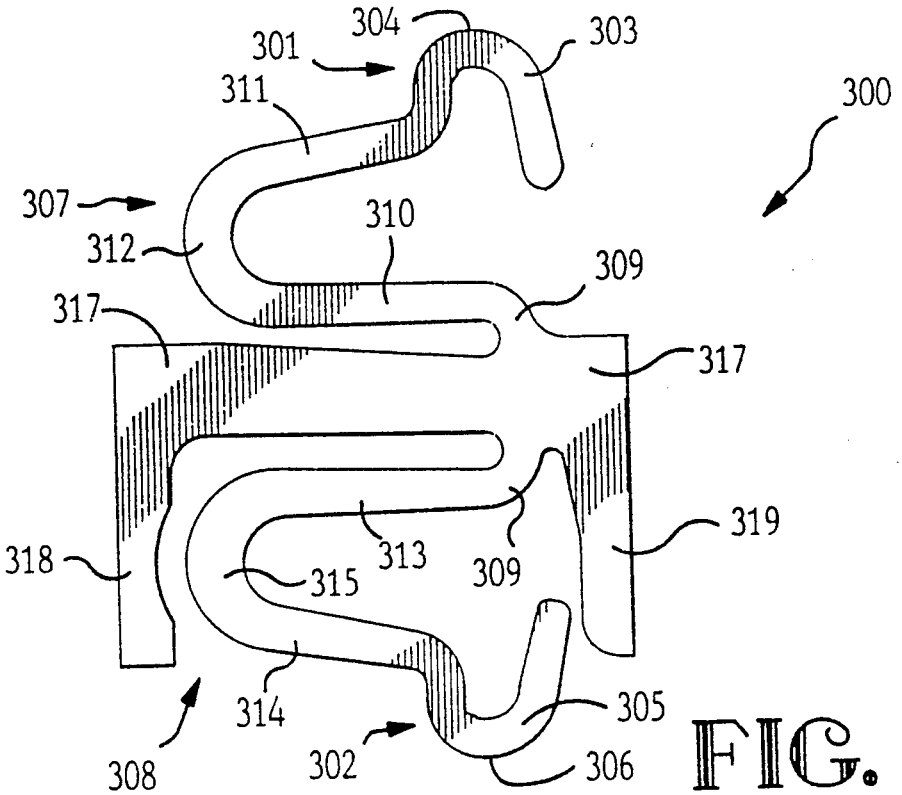
FIG. 1 is a perspective view of a contact in accordance with one embodiment of the present invention.
Figure 2:
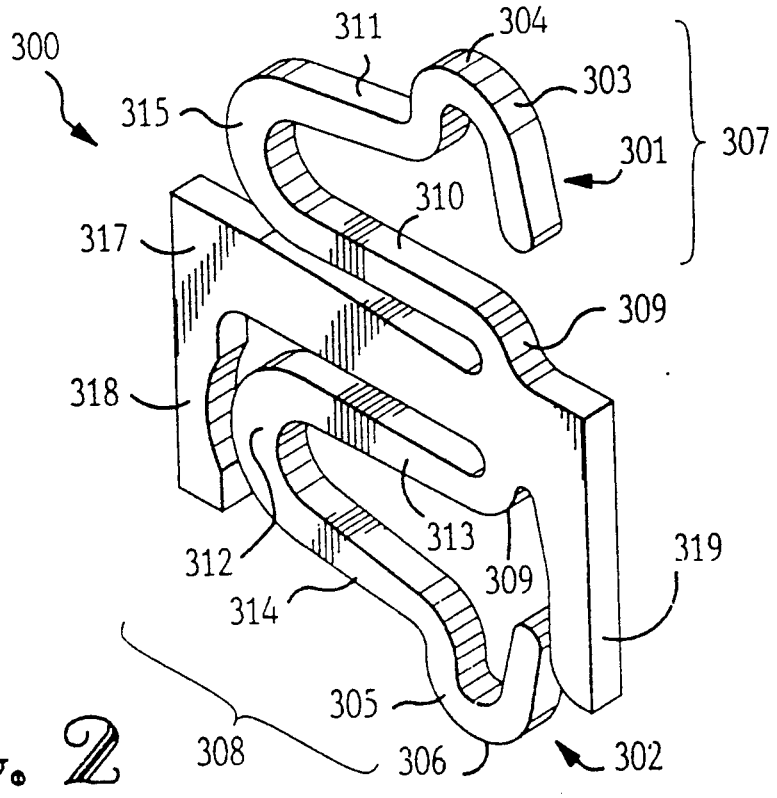
FIG. 2 is an isometric view of the contact shown in FIG. 1.

With particular reference now to FIGS. 1 and 2, a preferred embodiment of the present contact element is described. The preferred Contact element, indicated generally at 300, comprises first interface means or contact section 301 for electrically interfacing with an interfacing conductor, such as a conductive pad, on a first electronic component. As used herein, the term "electronic component" refers to any device adapted to receive or transmit electrical signals. Contact element 300 also comprises a second interface means or contact section 302 for electrically interfacing with an interfacing conductor, such as a conductive pad, on a second electronic component. In preferred embodiments, the interfacing means 301 and 302 are in opposed relationship to one another, that is, the means are adapted for deflection towards one another, as explained more fully hereinafter.

It will be appreciated that the interfacing means may vary widely in shape and size, depending primarily upon the particulars of the size and shape of the interfacing conductors on the associated electronic components. In numerous embodiments, the electronic component is a substantially flat printed wiring board and the interfacing conductor is a pad on a surface of the wiring board. In these and other embodiments, it is preferred that the first interfacing means comprise a nose 303 having an arcuate contact surface portion 304 for contacting such a pad. Likewise, the second interfacing means preferably comprises a nose 305 having an arcuate contact surface portion 306 for contacting a pad on a second printed wiring board. As used herein, the term "printed wiring board" (PWB) means an electronic component that includes a substantially flat portion adapted to bus data signals. Thus, the terms "printed wiring board" or "PWB" as used herein are intended to include such electronic components as printed circuit boards (PCBs) or any other electronic component which buses electrical signals from one location to another.

The contacts of the present invention comprise connecting means for electrically connecting said first and second interfacing means. The present connectors also comprise spring bias means for providing a first amount of spring bias to said first interface means and a second amount of spring bias to said second interface means. The spring bias means provides "mating resistance" to the contact. As the term is used herein, "mating resistance" refers to the resistance to deflection of an interface means that occurs during mating of the contact element with its associated electronic component. Those skilled in the art will appreciate that this resistance to mating deflection generally corresponds to the contact force of the interfacing means and that such contact force is an important parameter of such contact elements. For example, the level of required contact force is an important variable in the effectiveness of electrical contact and may generally vary depending upon the material of construction of the interfacing conductor on the electronic component.

In embodiments in which the interface means are opposed interface means, as shown in the figures, such deflection will generally constitute movement of the interfacing means towards one another. Applicants have discovered that it is highly desirable that, in certain embodiments, the first amount of resistance to mating deflection be independent from the second amount of resistance to mating deflection. In this way, the mating resistance means hereof can provide a first resistance which is adapted to maximizing the cycle-life of the contact. For example, preferred embodiments comprise a first interface means adapted to electrically interface at a separable or mating interface with a first electrical component under relatively low contact normal force between conductive surfaces which are gold-plated or plated with AMP DURAGOLD TM plating (trademark of AMP Incorporated, described in U.S.

Pat. No. 5,129,143). In this arrangement, highly effective contact can be made with such conductors at reduced contact forces as low as 80 grams. On the other hand, the opposed second interface means is adapted to electrically interface with a second electrical component which includes relatively high contact force conductive interfaces between conductive sources, such as tin or tin-lead plated. Effective contact with these conductors generally requires a minimum contact force of about 100 grams and preferably about 200 grams in an arrangement which is affixed together when assembled rather than matable and unmatable during in-service use.

According to embodiments of the type illustrated in the figures, the electrical connecting means and the mating resistance means are both comprised of the same structural elements. In particular, it is preferred that the mating resistance means comprise a first spring portion 307 connected to the first interface means 301 and a second spring portion 308 connected to the second interface means 302. The first and second spring portions 307 and 308 are also connected to one or more bights 309. It will be appreciated that for contacts in which the spring portions and the bight portions are formed of electrically conductive material, as is preferred, the mating resistance means also comprises means for electrically connecting the first and second interface means.

The first spring portion 307 comprises an inner arm 310 connected to a first end of bight 309 and an outer arm 311 connected to the interface means 301. The inner arm 310 and the outer arm 311 are connected by a first mating resistance means such as first resilient connection means 312 for resiliently resisting deflection of the outer arm 311 towards the inner arm 310, as normally occurs during mating of the contact with an electronic component. As shown, means 312 comprises a generally U-shaped segment in which the radius of the arcuate portion of the segment lies at least in part between the inner arm 310 and the outer arm 311. In this way, the outer arm 311 is generally opposed to the inner arm and moves toward the inner arm during mating deflection.

The second spring portion preferably similarly comprises an inner arm 313 connected to bight 309 and an outer arm 314 connected to second interface means 302. The inner arm 313 and the outer arm 314 are connected by a second mating resistance means such as second resilient connection means 315 for resiliently resisting deflection of the outer arm 314 towards the inner arm 313, as normally occurs during mating of the contact with an electronic component. As shown, means 315 also comprises a generally U-shaped segment in which the radius of the arcuate portion of the segment lies at least in part between the inner arm 313 and the outer arm 314. In this way, the outer arm 314 is generally opposed to the inner arm and moves toward the inner arm during mating deflection.

The mating resistance means comprises the first resilient connection means 312 providing a first amount of resilient resistance to deflection of the outer arm 311 towards the inner arm 310 and the second resilient connection means 315 providing a second amount of resilient resistance to deflection of the outer arm 314 towards the inner arm 313. According to preferred embodiments, such means comprise the arcuate portion of the second U-shaped segment being thicker in at least one dimension than the arcuate portion of the first U-shaped segment. In embodiments of the type illustrated in the figures, this is provided by the second U-shaped segment 315 having a width in the dimension normal to about the direction of deflection that is greater than the width of the same dimension of the first U-shaped segment.

Figure 8:
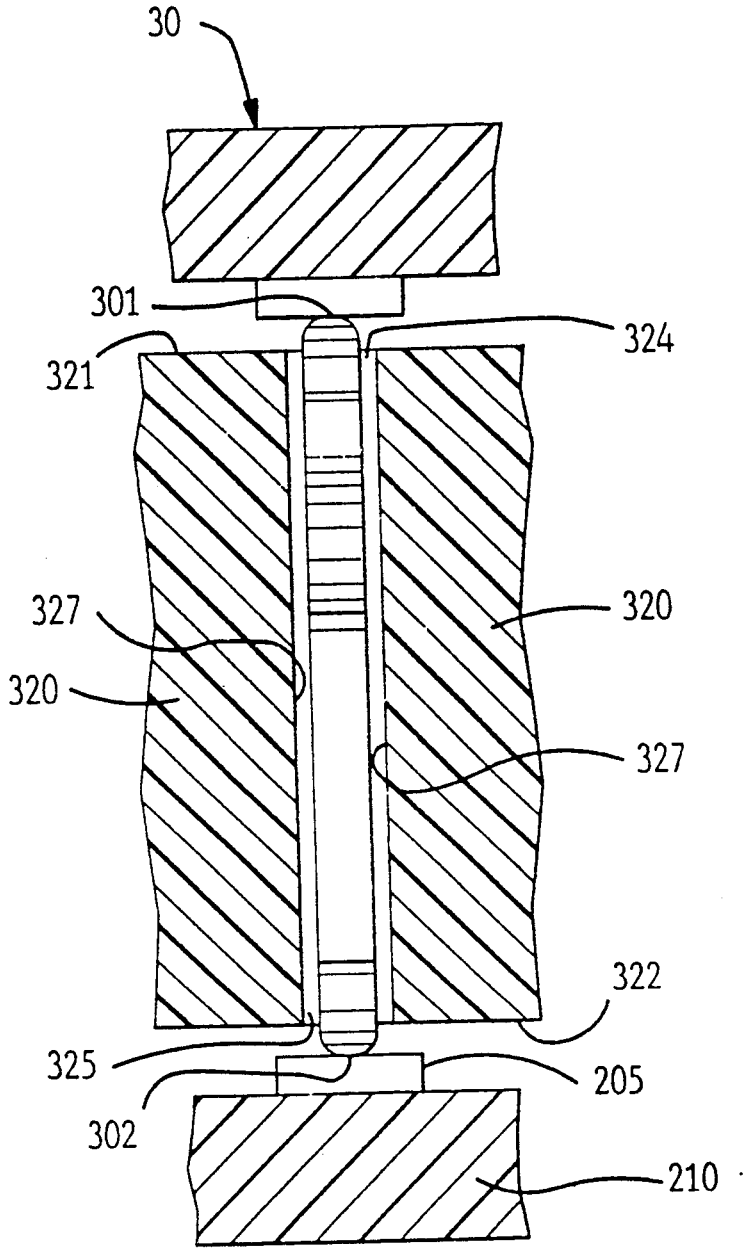
FIG. 8 is a cross sectional view taken along line 8—8 of FIG. 7.

As best illustrated in FIG. 8, the contact element illustrated in the figures hereof is a substantially flat element lying in a single plane, thus being able to be stamped from a sheet of metal with the motion of the contact interface means being substantially within that plane during mating deflection. It will be appreciated, however, that the present invention is not so limited and that numerous other shapes and configurations are adaptable for use in accordance with the teachings hereof.

Referring once again to FIG. 1, the interface means 301 and 302 are each eventually resiliently deflected upon completion of the mating operation so as to provide the required contact pressures. In order to facilitate the provision of contact elements having at least two levels of contact pressure, Applicants have discovered that it is preferred to provide means for decoupling the resilient response of the first interface means 301 from the resilient response of the second interface means 302. That is, it is desirable to provide means for allowing the action of spring portion 315 to act independently of the spring portion 312. If such decoupling means were not provided, the spring portion having the lower resilient resistance to mating deflection would tend to control or limit the resilient resistance potentially provided by the other spring portion.

Figure 7:
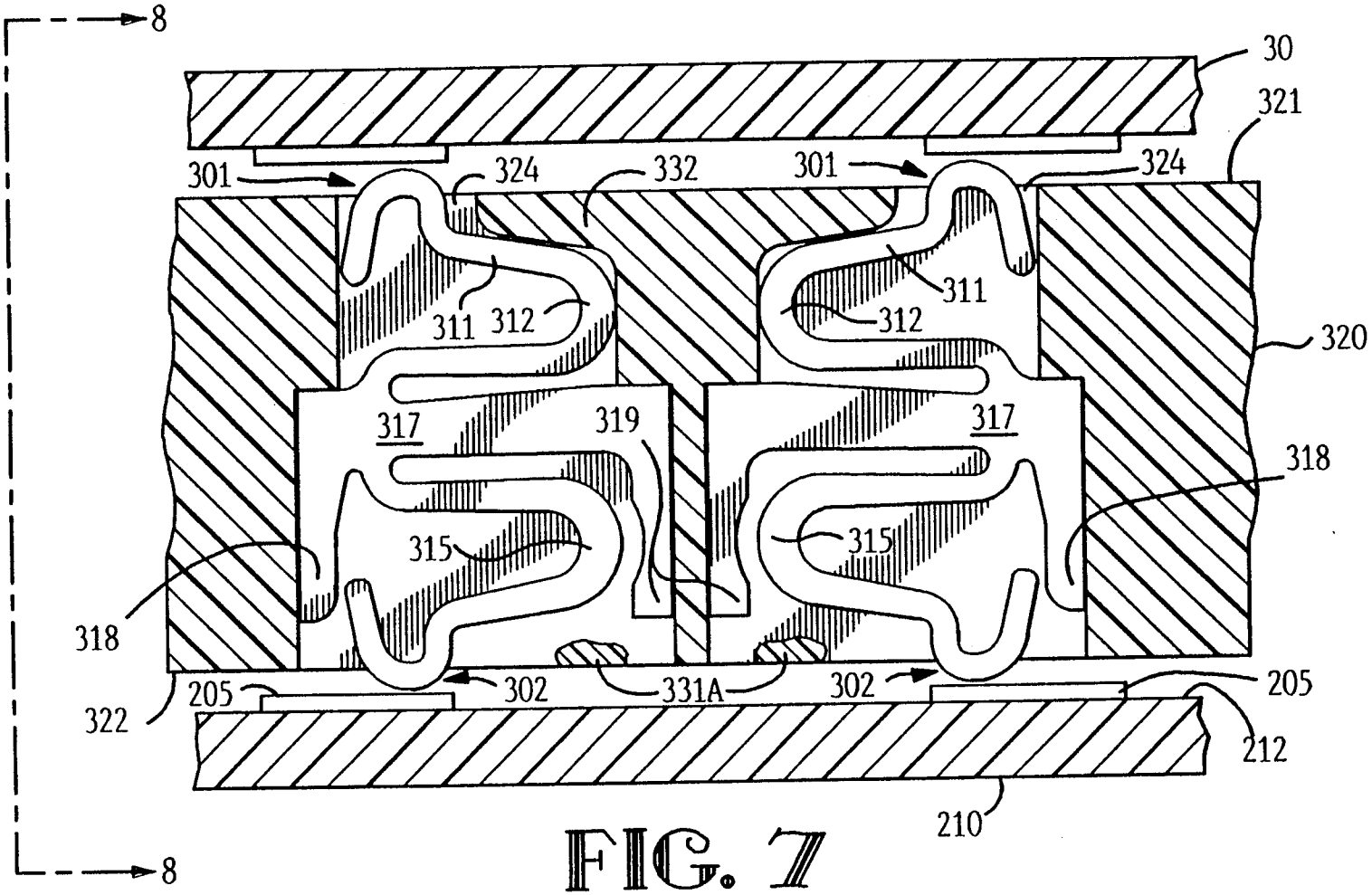
FIG. 7 is a semi-schematic view of a contact module in accordance with one embodiment of the present invention showing two contact elements in juxtaposition with two electronic components.

Referring to FIGS. 1 and 7, such decoupling means comprises a support means for supporting at least second interface means 302 against non-resilient translational movement. The support means preferably comprises a support arm 317 connected between bights 309 and extending generally in a direction about normal to the direction of deflection of interface means 301 and 302. As described more fully hereinafter, support arm 317 is adapted to mechanically interface with the interior edge walls of a cavity in an insulative housing for operatively holding the contact during the mating process. In this way, arm 317 is capable of supporting at least the second interface means 302 against non-resilient translational movement.

As noted above, Applicants have recognized that high cycle-life contacts are extremely desirable in certain applications. As the term is used herein, "cycle" refers to the cycle of operation experienced by an interface means and its associated spring portion as it proceeds through a mating and unmating procedure. Accordingly, the term "cycle-life" refers to the number of cycles, on average, that a contact element, or a portion of a contact element, is capable of withstanding without failure. The contact elements of the present invention are adapted to have a cycle-life of at least about 15,000 cycles and up to about 50,000 cycles.

Figure 6:
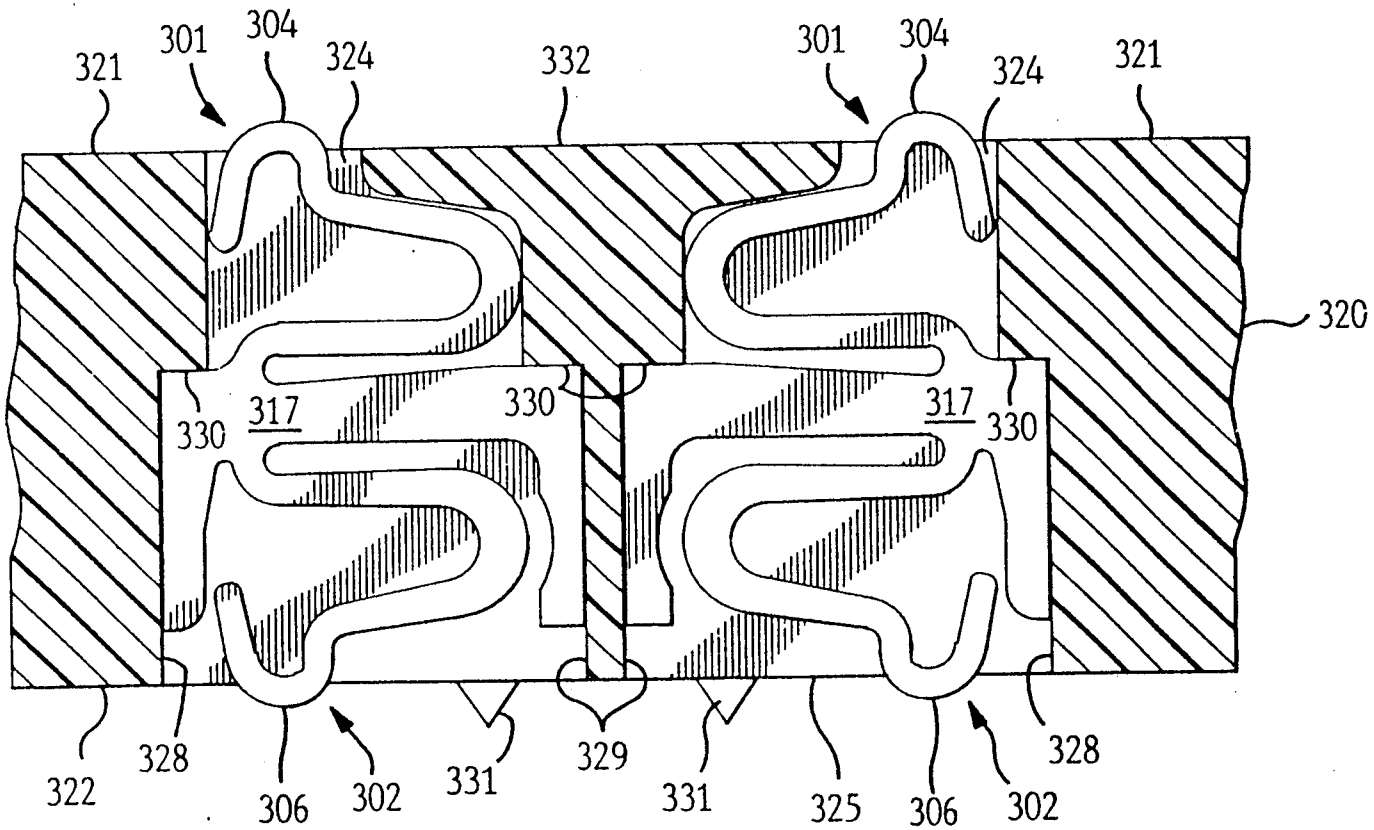
FIG. 6 is a cross sectional view of a contact module in accordance with one embodiment of the present invention showing two contact elements contained therein.

The contact elements of the present invention include stabilizing means for stabilizing the contact element against destructive torsion during in-service use. Such stabilizing means contributes to the high cycle-life of contact elements according to certain embodiments hereof. In FIG. 6, for example, the stabilizing means comprises elongate stabilizer arms 318 and 319 which extend from the ends of support arm 317 in a direction substantially parallel to the direction of deflection.

Contact elements of the general type described herein are commonly used in an interposer type arrangement which provides a contact system having a large plurality of contact elements disposed for operative mating with contact pads on electronic components. It is contemplated that the present contacts are adaptable for use with a large variety of such interposer arrangements, and the use of the present contacts in all such arrangements is within the scope hereof.

Figure 3:
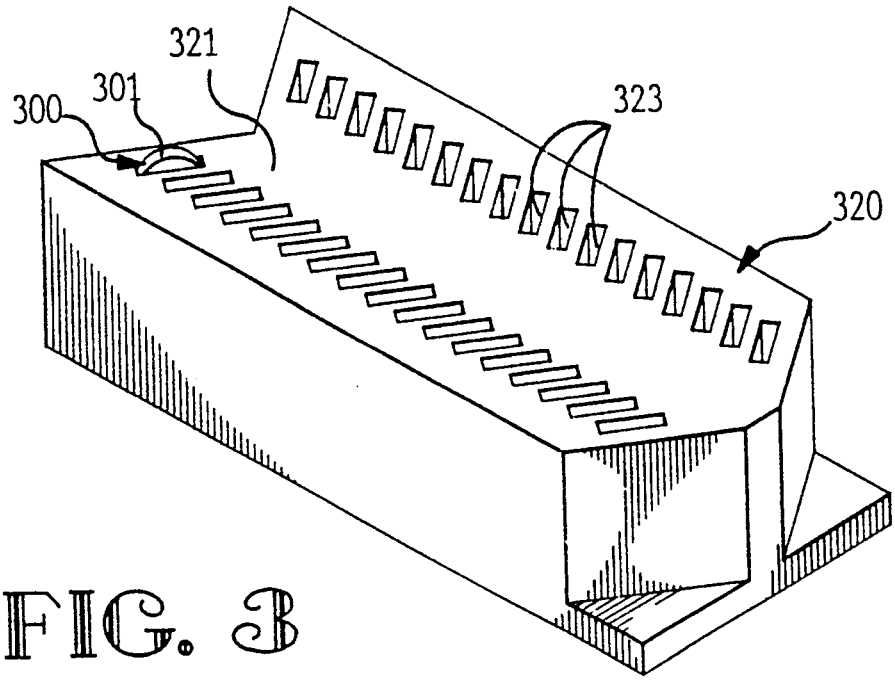
FIG. 3 is an isometric view of a contact module in accordance with one embodiment of the present invention showing a contact element contained therein.
Figure 4:
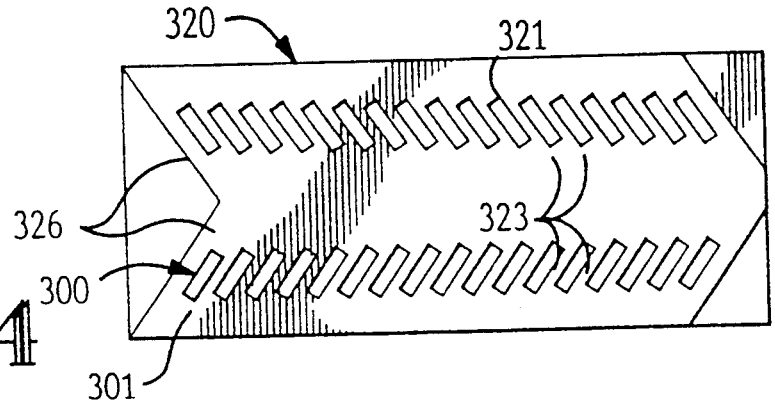
FIG. 4 is a plan view of the contact module of FIG. 3.
Figure 5:
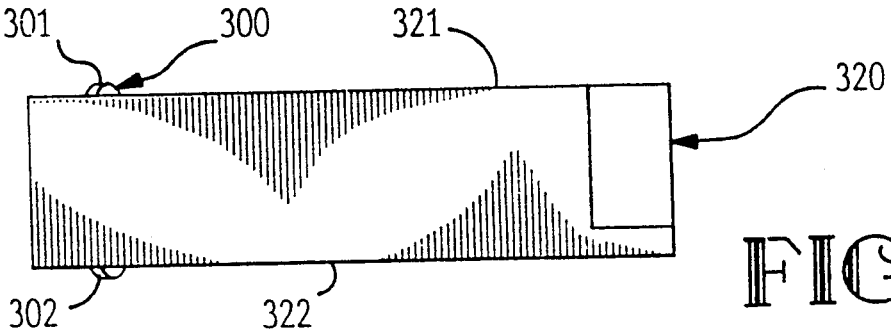
FIG. 5 is an elevation view of the contact module of FIG. 3.

In the disclosed embodiment, the interposer arrangement comprises a contact module comprising an insulative housing 320 as shown in FIGS. 3 to 5. The housing preferably has a first interface surface 321 and a second interface surface 322. The interface surfaces 321 and 322 are shown to be substantially flat surfaces which are substantially parallel to one another. A plurality of cavities 323 for containing respective contact elements 300 are formed in the housing 320. For the purposes of illustration, the interface means 301 and 302 of a single contact 300 are shown extending from the openings in the housing in FIG. 6. It will be appreciated that in operation a plurality of cavities 323 may contain respective ones of a like plurality of contact elements 300 hereof.

Best seen in FIG. 6, the cavities 323 define a first opening 324 in surface 321. Prior to mating with an electrical component, first interface means 301 extends through and beyond first opening 324 in the surface 304 thereof and is maintained in an elevated position relative to first interface surface 321 of housing 320. Likewise, cavities 323 also define a second opening 325 in second contact surface 322, and second interface means 302 extends through and beyond the opening and is maintained in an elevated position relative to the second interface surface 322 of housing 320. According to preferred embodiments, the housing 320 comprises a plurality of such cavities 323, and even more preferably two rows 326 of closely spaced parallel cavities, as shown in FIGS. 3 and 4.

One method for assembling the connector module will now be described. Housing 320 is formed of insulative material by standard and well known techniques, such as molding of fluid plastic resin material. The contact element is then inserted into the cavity 323 through opening 325. Each cavity is defined by side walls 327 and edge walls 328 and 329, as shown in FIGS. 6 to 8. Each of edge walls 328 and 329 are formed with a shoulder 330 adapted to allow passage of first contact interface means 301 to and through opening 324 in surface 321. However, shoulders 330 are adapted to mechanically interfere with translational movement of support means 317 towards opening 324 and thus act as a precisely located stop.

Contact elements 300 are preferably integrally formed, by stamping for example, from a sheet of conductive material. It is preferred that the forming process provides the contact or series of contacts with a frangible section or snap bar (not shown) attached to the ends of stabilizer arms 318 and 319 which aids in the insertion of the contact into the cavity 323. After the contact element 300 is inserted in cavity 323, the snap bars are removed as is well known in the art. A portion of the edge of side-walls 327 which comprise surface 322 is formed with a ridge 331 of plastic (see FIG. 5). Since ridge 331 is located on the sidewall 327, it does not interfere with insertion of the contact element 300 into cavity 323. After the snap bar is removed, however, ridge 331 is flattened, preferably by heat staking of the plastic to the level of surface 322, defining an embossment 331A (FIG. 7) traversing the entrance to cavity 323 and providing a means for preventing inadvertent dislocation of the contact element from the cavity 323 outwardly from opening 325.

Figure 9:
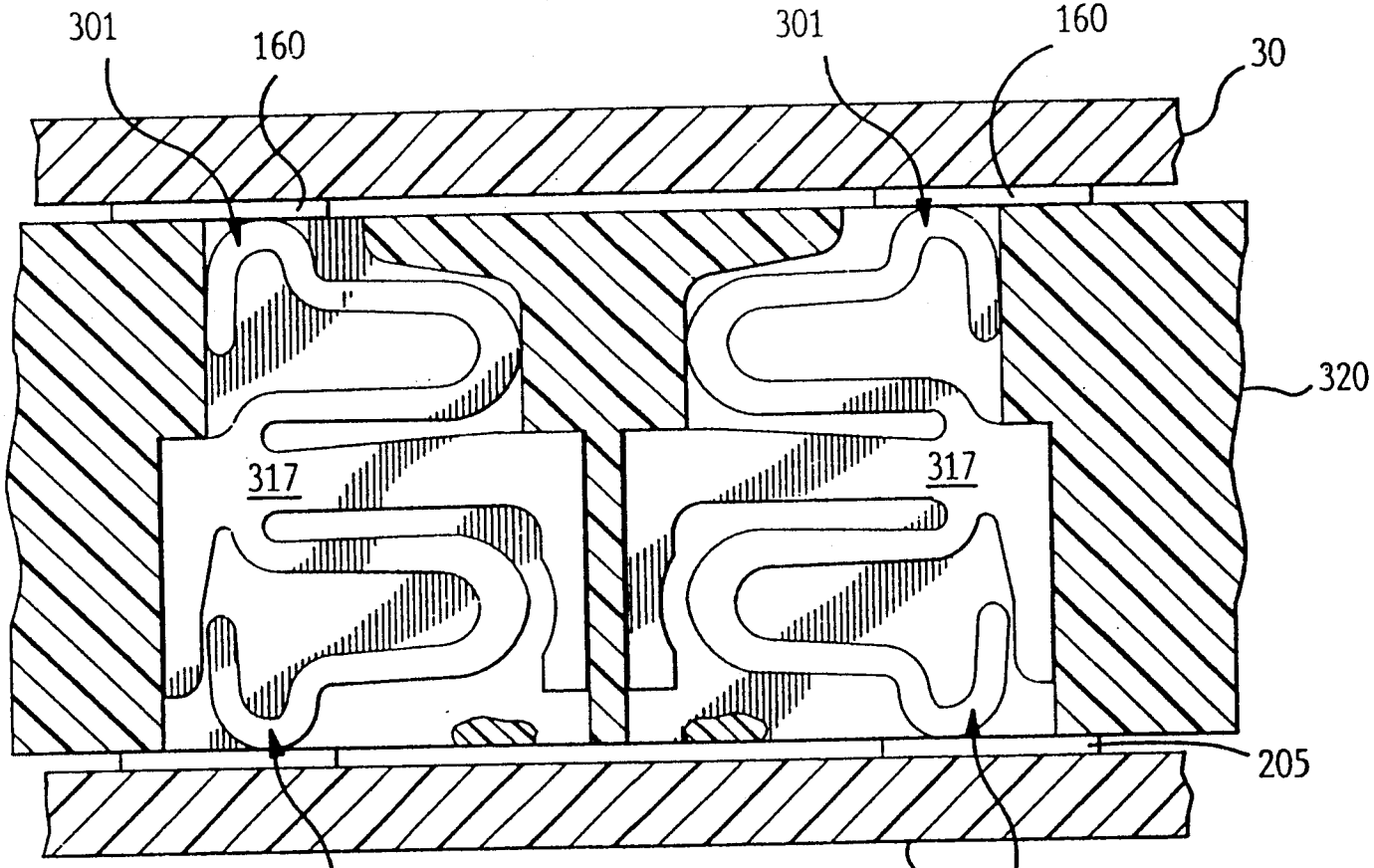
FIG. 9 is a semi-schematic view of a contact module in accordance with one embodiment of the present invention showing two contact elements fully mated with two electronic components.

The mating of a contact element according to the present invention with first and second electrical components will now be described in connection with FIGS. 7–9. FIGS. 7 and 8 illustrate the pre-mating position of the electrical components and the contact elements, and FIG. 9 illustrates both components being fully mated with the contact module. It is contemplated that mating of the first and second components may proceed in any order desired. That is, either component 30 or 210 may be first mated with the contact followed by mating of the remaining component, or mating of each component may proceed substantially simultaneously. However, the preferred mating process will now be described.

In the preferred mating process, a first electrical component, such as PWB 210, is first juxtaposed to the connector module 320 such that the interface surface 322 thereof is substantially parallel to the surface 212 of the PWB and such that contact pads 205 thereof are in operative alignment with the second interface means 302 of the connector element 300. Means and methods for obtaining such juxtaposition and alignment are readily available to those skilled in the art; one such means is described hereinafter. Electrical component 210 is then brought into mated and fastened relationship to the connector module 320. That is, the surface 212 (more accurately, raised pads 205 thereof) is brought into intimate contact with interfacing surface 322 of connector module housing 320 by any means well known in the art, although one means for mating is described hereinafter.

Second interface means 302 of contact element 300 engages pad 205 upon assembly of interposer nest 200 containing connector modules 320 to bolster plate 190 on which is disposed electrical component 210 (see FIG. 12), and as a result produces a force on the contact which urges translation of the contact towards the opening 324 in the opposite interfacing surface 321. This initial deflection continues until support arm 317 mechanically interferes with shoulders 330, thus preventing further translation of the contact element. Furthermore, the translational interference between shoulders 330 and support arm 317 serve to decouple spring portions 307 and 308 such that spring portion 307 can effectively operate at its lower contact pressure despite the presence of a higher contact pressure at pad 205.

The dimensions of contact element 300 and the connector module cavity 323 are further selected such that surface 322 of the connector module 310 is not fully mated with surface 212 of PWB 210 when support arm 317 is in intimate contact with shoulders 330. As the assembly operation is completed and surface 322 is fully mated to surface 212, as shown in FIG. 9, the second interface means 302 is deflected so as to relieve the continued stress caused by the mating operation. The spring portion 308 resiliently resists this deflection, thereby creating a contact normal force at pad 205.

In the embodiment shown in the figures, the second contact interface means 302 provides a relatively high contact force, such as would be required for contact pads 205 formed of tin or tin-lead, where a contact force of about 200 gm. may be desirable.

It is preferable that electrical component 210 be substantially permanently affixed and mated to contact module 320, although it will be appreciated that such permanence is not required hereby. In contrast, electrical component 30 is adapted to be repeatedly mated to and unmated from contact module 300. The mating of electrical component 30 proceeds substantially as described above for component 210, except that the entirety of the stress produced by the mating operation for component 30 is relieved by spring portion 307 as first interface means 301 is deflected from its unloaded position. As a result, a contact pressure corresponding to the resistance to deflection of spring portion 307 is produced at pad 160. Pads 160 of board 30 are shown to be easily disengageable from first interface means 301 for many mating cycles, and preferably are gold-plated for which a reduced contact normal force of about 80 gms is satisfactory, and desirable. Optionally, first contact interface means 301 may be preloaded by spring arm 311 being raised against surface 332 upon assembly of contacts 300 in contact module 320, or upon mounting of loaded module 320 to board 210.

Due primarily to the effect of support arm 317 decoupling lower part from upper part, contact element 300 comprises a high cycle-life contact. To some extent, alignment arms 318 and 319 in interference fit with edge walls 327 and 328 and side walls 327 serves to stabilize and rigidify the contact element during the mating process. The contact element hereof thus exhibits significant resistance to degradation and failure even after numerous mating and unmating cycles. While each contact member 300 is stamped from a sheet of conductive material such as beryllium copper alloy of selected thickness, the sheet may be coined to define a lesser stock thickness at first interface means 301, including inner and outer arms 310, 311 and bight 312 (as 0.004 inches), turn at second interface means 302; including inner and outer arms 313, 314 and bight 312 therebetween (such as 0.006 inches) and preferably including support and stabilizer arms 317, 318 and 319.

It will be appreciated by those skilled in the art that the present contact modules and elements are adaptable for use in a wide variety of connector systems and for a wide variety of applications. An example of the use of the present contact modules and elements in a particular connector system is shown in FIGS. 10 to 13. It will be appreciated, however, that the description of the present contact modules and elements in respect to this particular connector systems is done for the purposes of illustration but is not limiting of the invention.

Figure 10:
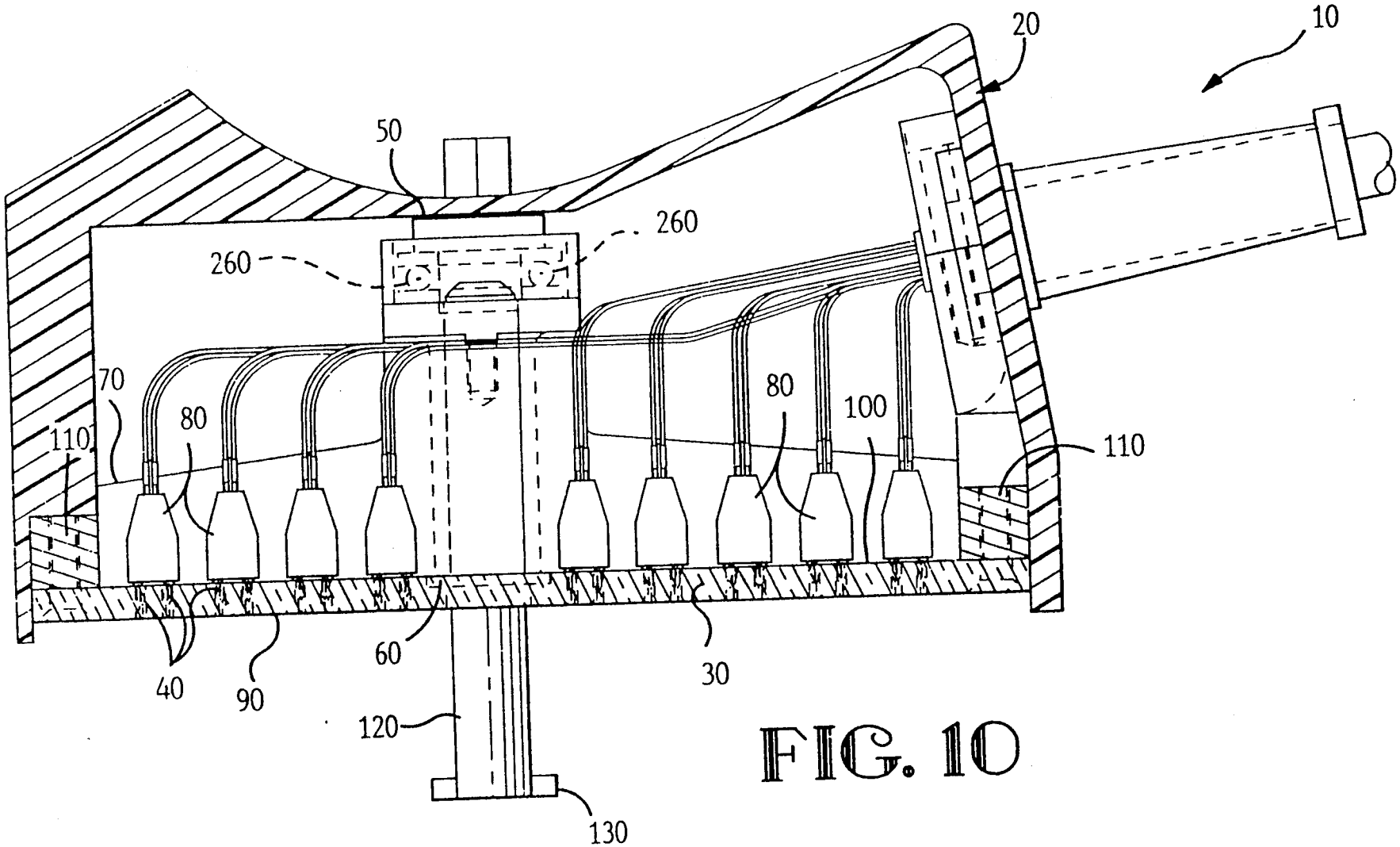
FIG. 10 is a side elevational view of a connector in accordance with the present invention having a connector module interfaced to a printed wiring board mounted in the connector.
Figure 11:
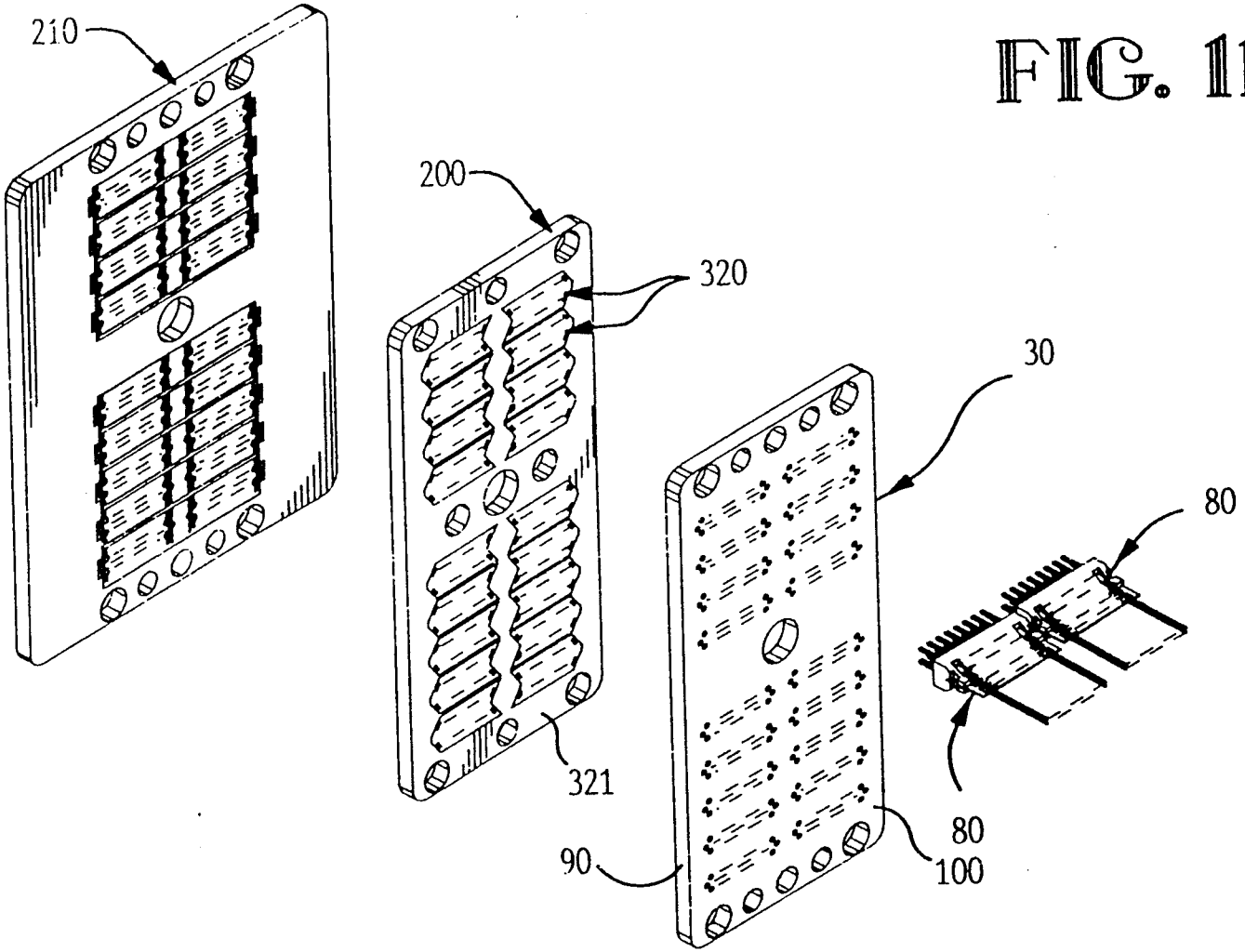
FIG. 11 is an exploded isometric view showing the relationship between two electronic components and an interposer containing contacts of the present invention.

Referring now to FIG. 10, a connector, shown generally at 10, is adapted to electrically interface contact pads on the underside 90 of PWB 30 to contact elements of the present invention, and as disclosed in greater particularity in U.S. patent application Ser. No. 07/996,750 Dec. 24, 1992. Connector 10 comprises housing means 20 for mounting PWB 30, which is adapted to receive connector elements that will communicate data from an outside source to the connector 10. PWB 30 preferably comprises a plurality of plated-through-holes 40 which mate with the connector elements and then interface the data signals from the connector 10, through the contact elements hereof, and to the device which will utilize the data. Connector 10 and modular connectors 80 are especially suitable for termination to a cable 225 containing a great number of discrete high performance coaxial wires 230 having a very small gage such as 40 AWG having a center conductor diameter of 0.00314 inches. The outer cable jacket 227 is firmly affixed to connector 10 by strain relief 220. Each modular connector 80 can be of the type terminating sixteen coaxial wires 230.

Housing 20 preferably further comprises a support structure 70 which secures PWB 30 to the device when the securing means is actuated. Modular connectors 80 are mated in the plated-through-holes 40 on the top side 100 of PWB 30. The side 100 of PWB 30 is adapted to attach PWB 30 to a securing surface 110 on connector 10. The first side 100 of PWB 30 is interfaced in a preferred embodiment to securing surface 110 which holds PWB 30 in place in connector 10. In this fashion, PWB 30 is securely attached to connector 10 so that modular connectors 80 can be effectively plugged into PWB 30 through plated-through-holes 40. Top side 100 of PWB 30 is sometimes referred to herein as the connector side since it interfaces with connector modules 80.

Figure 15:
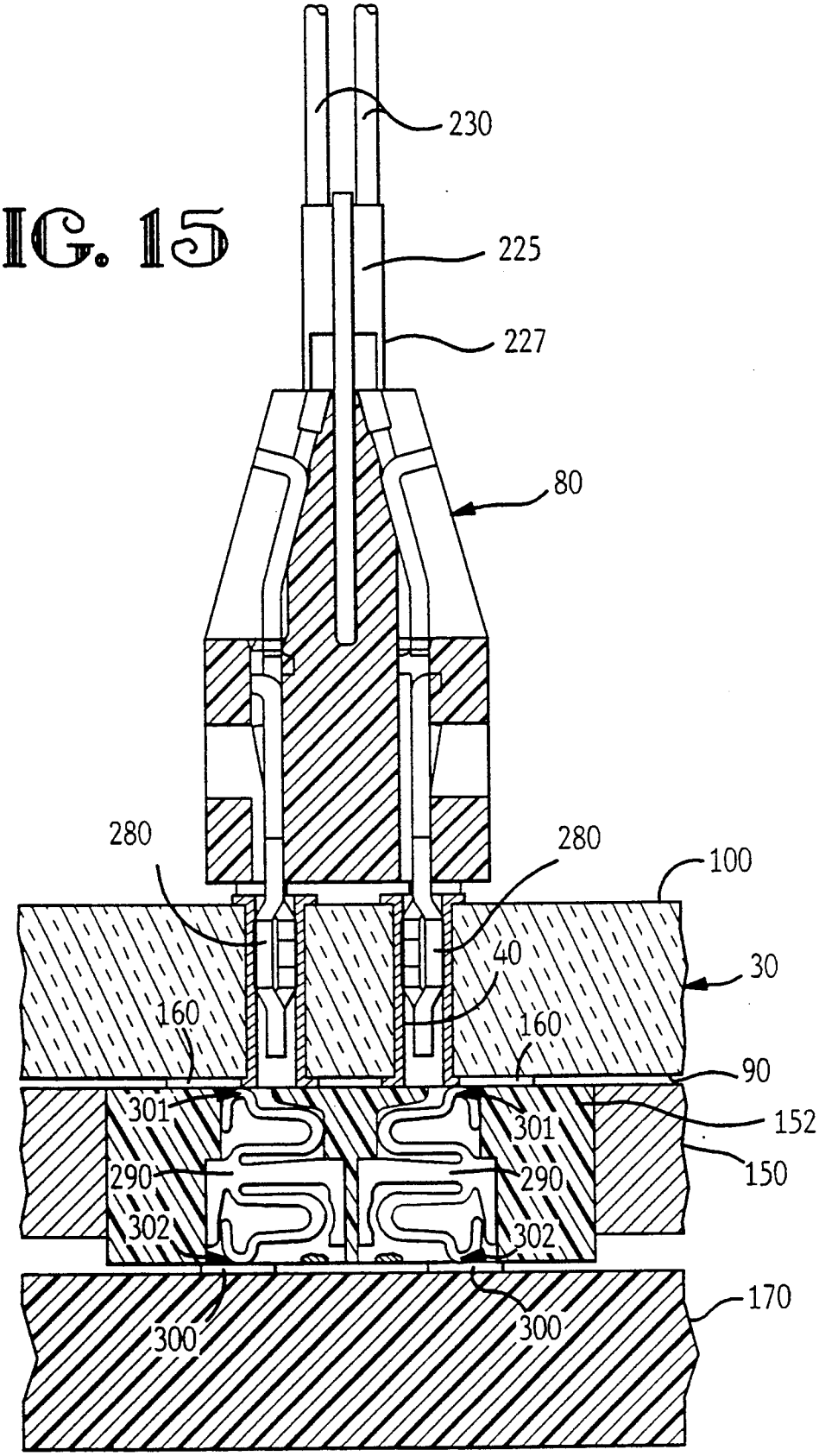
FIG. 15 is a cross sectional view of a connector provided in accordance with the present invention having a modular connector mounted to a printed wiring board which is further interfaced with an interposer and a second printed wiring board that are both mounted to a device which will utilize data bussed through the connector.

The connectors and connector modules provided in accordance with the present invention are adapted to form a "separable interface" with one or more electronic components in the device. The separable interface is formed by implementing a high density land grid array. To develop this land grid array, an interposer shown at 200 in FIGS. 11 to 15 is provided to the connector system to create the separable interface. The interposer 200 provides cavities 340 for accepting and nesting a plurality of contact modules 320 having contact elements 300 of the present invention contained therein. In land grid array connector packaging provided in accordance with the present invention, the land grid array contacts are sandwiched between the PWB 30 and a substrate 210 secured in the device with the interposer 200 therebetween. Since the bottom side 90 of PWB 30 is interfaced with such interposer system, this side of the PWB is sometimes denoted herein as the "interposer" side. As shown in FIG. 15, the interposer side 90 of PWB 30 contains a plurality of contact surfaces or pads 160 for electrically interfacing with respective electrical contact members 300 contained in the land grid array. The substrate 210 in the device is preferably a second PWB which may be a motherboard that contains data processing electronics.

Figure 12:
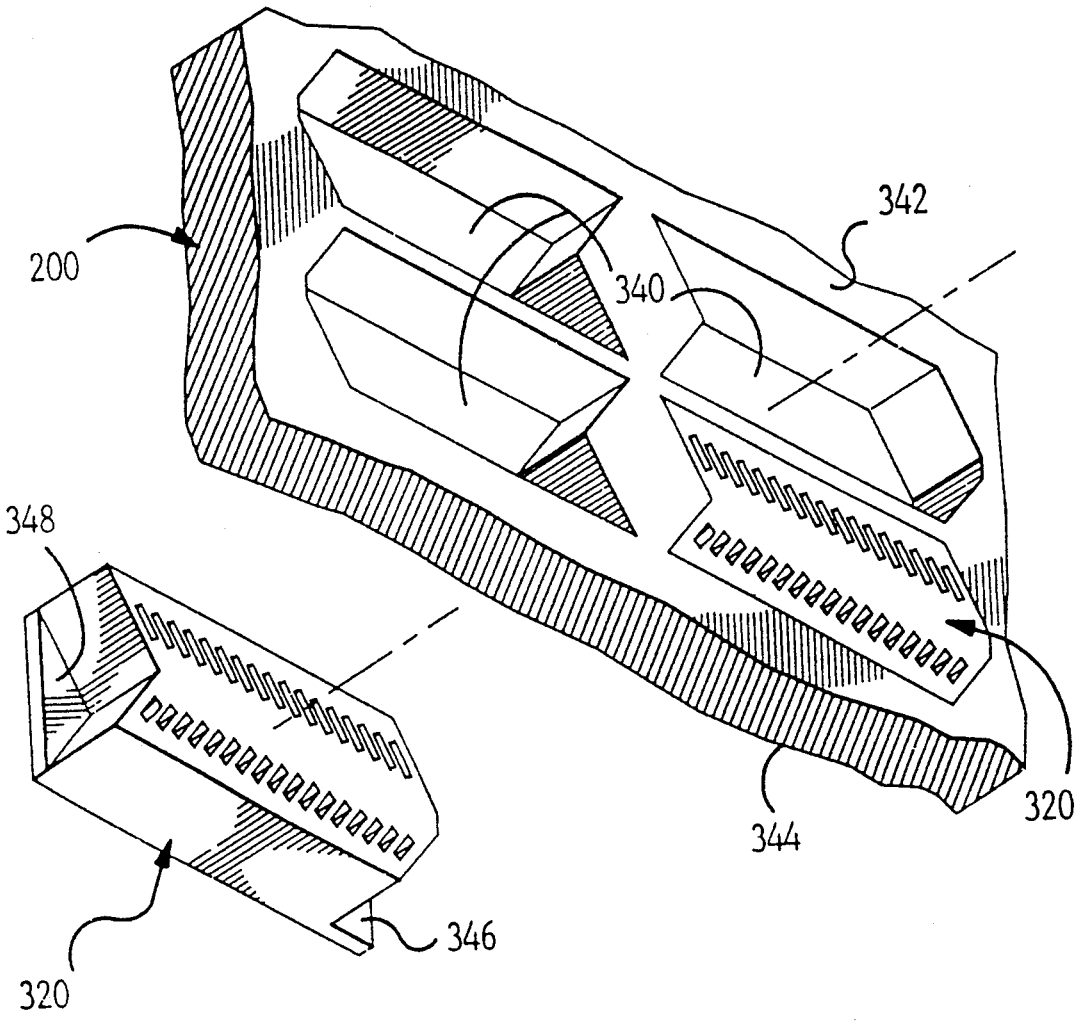
FIG. 12 is an enlarged isometric view of a portion of an interposer nest receiving a representative contact module into a cavity.
Figure 18:
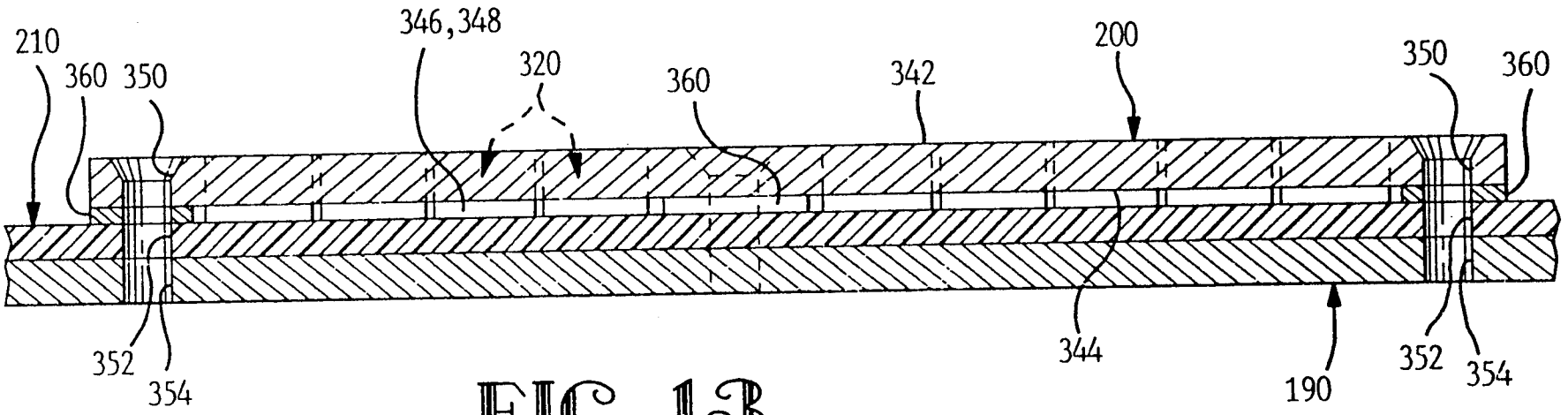
Figure 14:
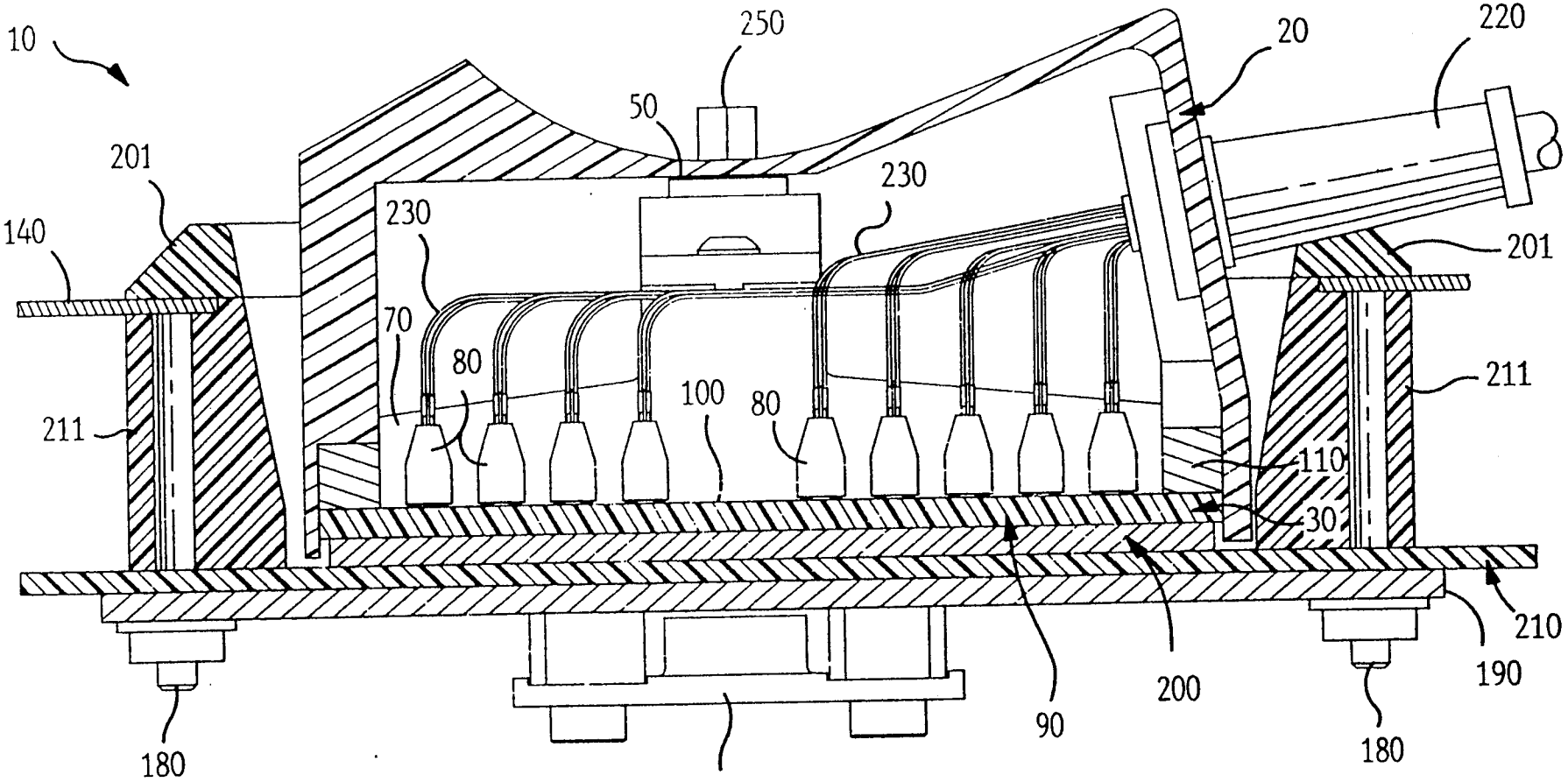
FIG. 14 is also a side elevational view of a connector provided in accordance with the present invention having a modular connector mounted to a printed wiring board which is further interfaced with an interposer and a second printed wiring board that are both mounted to a device which will utilize data bussed through the connector.

Referring to FIG. 12, interposer nest 200 may be of metal and contain an array of module-receiving cavities 340 extending from a first surface 342 to a second surface 344, with first surface 342 associated with PWB 30 and second surface 344 associated with PWB 210. Each cavity 340 is shaped asymmetrically to complement the asymmetric shape of a respective contact module 320 permitting only one orientation of module 320 and thereby being polarized. Each contact module 320 preferably includes lip sections 346,348 of common thickness, which abuts adjacent portions of second surface 344 of interposer nest 200 upon insertion into a respective cavity 340. Abutment of lip sections 346,348 against second surface 344 enables contact module insertion to a precisely controlled depth. Preferably the dimensions of modules 320 are incrementally larger than the dimensions of module-receiving cavities 340 defining an interference fit upon being urged thereinto.

Referring to FIG. 13, interposer nest 200 includes mounting holes 350 which are alignable with corresponding mounting holes 352 of PWB 210 and mounting holes 354 of bolster plate 190 thereunder, for receipt of fasteners (not shown) which assemble interposer nest 200 to the framework of a device to which the connector 10 is to be mated, in biased engagement against PWB 210 mounted to bolster plate 190, generating the requisite contact normal force between the second interface means 302 of the contacts 300 secured in the cavities of contact modules which are secured in the interposer nest 200. Lip sections 346,348 of the contact modules are seen disposed between second surface 344 of interposer nest 200 and PWB 210. Spacer elements 360 are seen surrounding mounting holes 350 of interposer nest 200 spacing interposer nest 200 with respect to PWB 210 upon assembly, to relieve stress on lip sections 346,348 of contact modules 320. Utilizing of lip sections 346,348 permits removal of a contact module 320 for repair or replacement thereof during servicing.

As discussed above and as shown in FIG. 12, the motherboard 210 is also preferably a PWB which is mated to the device and contains the particular electrical and electronic components which will process the data bussed through modular connectors 80 in PWB 30 from the outside source. In a preferred embodiment, motherboard 210 is fixed in the device. In particular, a bolster plate 190 is mounted to device 140 so that the motherboard 210 can be securely mounted in the device when attached to the bolster plate. Bolster plate 190 provides a sturdy surface for the mounting screws or studs 180 so that the connector system 10 can be mated in tight engagement with the device 140 through system PWB 210. Mounting screws 180 further interface to the device 140 through an outer bezel 201 that is formed integrally with an inner standoff bezel 211 which together form a frame in which connector 10 is mounted when in contact with the interposer 200 and system PWB 210 which is mounted in device 140.

Securing barrel means 120 traverses through opening 60 in PWB 30, and corresponding openings provided in interposer 200, system PWB 210, and bolster plate 190. In a further preferred embodiment, securing barrel means is a solid barrel made of a rigid material such as stainless steel. The interlocking means 130 is preferably integrally formed on a distal end of barrel 120 from the same material as barrel 120 and interfaces to the mating surface 240 to cinch the interlocking means 130 and barrel 120 to the device 140. Reference again is made to U.S. patent application Ser. No. 07/996,750 (Whitaker Case No. 15361) filed Dec. 24, 1992 for more particular disclosure of this arrangement.

Interposer 200 is substantially permanently registered to the motherboard 210. Such registration produces a high density of relatively high contact force interfaces between a plurality of interface means 302 and a plurality of corresponding pads 205 on motherboard 210 (FIG. 15). Thus, since the interposer 200 contains a large number of contact elements 300, each contact interface 302 is substantially simultaneously mated with a pad 205 in accordance with the assembly operation described hereinbefore.

Once the interposer is substantially permanently registered to the motherboard 210, the pads 160 on the interposer side 90 of PWB 30 can then be positioned to mate with contact elements 300 in the interposer. Preferably, PWB 30 is placed in initial contact with interposer nest 200 under zero force, and a force generating mechanism is then activated to complete the connection. The force generating mechanism is preferably barrel 120 which applies the force to PWB 30 to complete the connection in the separable interface. Any type of force generating mechanism is suitable to provide the required force to mate PWB 30 to interposer nest 200 which is interfaced to system PWB 210 and will vary according to the individual application requirements of connector 10.

FIG. 15 illustrates the engagement of the contact surfaces 160 with the interposer 200. The modular connector elements 80 are interfaced in the plated-through-holes 40 of PWB 30 by electrical interface pins shown generally at 280. The electrical interface pins 280 on modular connectors 80 make physical contact with the tin-plated surfaces of plated-through-holes 40 so that electrical transmission can occur through the plated-through-holes to the contact elements 300 in interposer 200. A preferred construction of modular connector elements 80 is described in commonly assigned copending application U.S. Pat. No. 5,190,473, the teachings of which are specifically incorporated herein by reference. Additionally, methods of manufacturing modular connector elements which can be used in accordance with the present connector systems are described in AMP Incorporated Technical Paper by R. Rothenberger and R. S. Mroczkowski, entitled "High-Density Zero Insertion Force Microcoaxial Cable Interconnection Technology," (1992), the teachings of which are also specifically incorporated herein by reference. An improved PWB 30 having novel ground-to-signal circuitry for enhanced impedance is disclosed in U.S. patent application Ser. No. 07/996,557 (15359) filed Dec. 24, 1992 (concurrently herewith) and assigned to the assignee hereof.

Electrical interface pins 280 are interfaced through plated-through-holes 40 which are further preferably in electrical communication with contact surfaces 160 so that sufficient electrical connections are made from the outside source through the modular connector elements 80 to the PWB 30. When the PWB 30 is secured against interposer 200, the contact surfaces 160 are placed in electrical communication with interposer contact elements 300 hereof. The interposer contact elements 300 are also interfaced at the lower surface of the interposer 200 to contact surfaces 205 on the system PWB 210. Similar plated-through-holes 290 on the system PWB are adapted to interface with electrical interface pins in the device 140 so that data can be bussed to the various areas on system PWB 210 which contain electronic components that process the data for the analytical or diagnostic purposes for which the device was designed.

Thus the contacts, contact modules, connectors and methods described and claimed in accordance with the present invention ensure high integrity contact surface interfaces. Furthermore, the present invention provides contacts and contact systems which are high cycle-life and reliable.

There have thus been described certain preferred embodiments of contacts and connector systems provided in accordance with the present invention. While preferred embodiments have been described and disclosed, it will be recognized by those with skill in the art that modifications are within the true spirit and scope of the invention. The appended claims are intended to cover all such modifications.

What is claimed is:

1. An electrical contact for electrically mating with two electronic components comprising:

(a) first interface mans for electrically mating with a first electronic component;

(b) second interface means for electrically mating with a second electronic component;

(c) connecting means for electrically connecting said first and second interface means; and (d) first mating resistance means for providing a first amount of mating resistance to mating deflection of said first interface means; and (e) second mating resistance means for providing a second amount of mating resistance to mating deflection of said second interface means different from said first amount of mating resistance.

2. The electrical contact of claim 1 further comprising means for decoupling the first mating resistance of said first interface means from the second mating resistance of the second interface means.

3. The electrical contact of claim 1 wherein said first and second interface means are opposed interface means.

4. The electrical contact of claim 1 wherein said first amount of resistance to mating deflection is less than about fifty percent of the second amount of mating resistance.

5. The electrical contact of claim 1 wherein said mating resistance comprises a first spring portion connected to the first interfacing means and a second spring portion connected to the second interfacing means.

6. The electrical contact of claim 5 wherein said first and second spring portions each comprise an inner arm, an outer arm and resilient connection means for resiliently resisting deflection of said outer arm towards said inner arm, said outer arm of said first spring portion being connected to said first interface means and said outer arm of said second spring portion being connected to said second interface means.

7. The electrical contact of claim 6 wherein said first and second resilient connection means each comprise a U-shaped segment, the radius of said segment lying at least in part between said inner arm and said outer arm.

8. The electrical contact of claim 7 wherein the arcuate portion of said second U-shaped segment is thicker in at least one dimension than the arcuate portion of said first U-shaped segment in said at least one dimension such that the first amount of resistance to mating deflection is substantially less than the second amount of resistance to mating deflection.

9. The electrical contact of claim 8 wherein said second U-shaped segment has a width in the dimension normal to about the direction of deflection of said second interface means that is greater than the width of said first U-shaped segment in the dimension normal to about the direction of deflection of said first interface means.

10. An electrical contact of the type for providing an electrical path between two electrical conductors comprising:

(a) a first contact section at a first end for electrically interfacing with a first electrical conductor:

(b) a second contact section at a second opposed end for electrically interfacing with a second electrical conductor;

(c) a body section for electrically and mechanically connecting said first and second contact sections, said body section including a first mating resistance means for providing a first amount of resilient resistance to mating deflection of said first contact section and a second mating resistance means for providing a second amount of resilient resistance to deflection of said second contact section; and (d) a support section located between said first and second mating resistance means for supporting at least one of said first and second mating resistance means against non-resilient translational movement toward the other thereof upon cooperation with a corresponding portion of a housing containing the contact.

11. The electrical contact of claim 10 wherein said first amount of resistance to mating deflection is less than about fifty percent of the second amount of mating resistance.

12. The electrical contact of claim 10 wherein said support section comprises an elongate support arm extending generally in a direction about normal to the direction of deflection of said second contact section.

13. The electrical contact of claim 10 wherein said body section includes a first spring portion connected to the first and a second spring portion connected to the second contact section.

14. The electrical contact of claim 13 wherein said first and second spring portions each comprise an inner arm, an outer arm and a bight section therebetween for resiliently resisting deflection of said outer arm towards said inner arm, said outer arm of said first spring portion being connected to said first interface means and said outer arm of said second spring portion being connected to said second contact section.

15. The electrical contact of claim 14 wherein said support section comprises an elongate support arm extending generally in a direction about normal to the direction of deflection of said second contact section and further comprising a first bight connected between said inner arm of said first spring portion and said support arm and a second bight connected between said inner arm of said second spring portion.

16. The electrical contact of claim 14 wherein said first and second bight sections each comprise a U-shaped segment, the radius of said segment lying at least in part between said inner arm and said outer arm.

17. The electrical contact of claim 16 wherein the arcuate portion of the second U-shaped segment is thicker in at least one dimension than the arcuate portion of the first U-shaped segment in said at least one dimension such that the first amount of resistance to mating deflection is substantially less than the second amount of resistance to mating deflection.

18. The electrical contact of claim 17 wherein said second U-shaped segment has a width in the dimension normal to about the direction of deflection of said second interface means that is greater than the width of said first U-shaped segment in the dimension normal to about the direction of deflection of said first interface means.

19. A contact module for providing an electrical path between two electrical conductors comprising:

(a) a housing comprised of insulating material and having a first interfacing surface, a second interfacing surface and a cavity which defines an opening in said first interfacing surface and an opening in said second interfacing surface;

(b) a contact element substantially contained in said cavity, said contact element comprising:

(i) a first contact section adjacent said first opening for electrically interfacing with a first electrical conductor;

(ii) a second contact section adjacent said second opening for electrically interfacing with a second electrical conductor:

(iii) a body section for electrically and mechanically connecting said first and second contact sections and including first mating resistance means for providing a first amount of resilient resistance to deflection of said first contact section towards said second contact section and further including a second mating resistance means for providing a second amount of resilient resistance to deflection of said second contact section toward said first contact section; and (iv) a support section in mechanical contact with said housing for supporting at least one of said first and second mating resistance means against non-resilient translational movement toward the other thereof.

20. The contact module of claim 19 wherein said first amount of resistance is substantially less than said second amount of resistance.

21. The contact module of claim 19 wherein said first amount of resistance to mating deflection is less than about fifty percent of the second amount of mating resistance.

22. The contact module of claim 19 wherein said first and second contact section are opposed interface means.

23. The contact module of claim 19 wherein said cavity comprises a plurality of cavities and said contact comprises two or more contacts contained in two or more of said plurality of cavities.

24. The contact module of claim 19 wherein said body section includes a first spring portion connected to the first contact section and a second spring portion connected to the second contact section.

25. The contact module of claim 24 wherein said first and second spring portions each comprise an inner arm, an outer arm and a bight section for resiliently resisting deflection of said outer arm towards said inner arm, said outer arm of said first spring portion being connected to said first contact section and said outer arm of said second spring portion being connected to said second contact section.

26. The contact module of claim 25 wherein said first and second bight sections each comprise a U-shaped segment, the radius of said segment lying at least in part between said inner arm and said outer arm.

27. The contact module of claim 26 wherein the arcuate portion of the second U-shaped segment is thicker in at least one dimension than the arcuate portion of the first U-shaped segment in that same dimension such that the first amount of resistance to mating deflection is substantially less than the second amount of resistance to mating deflection.

28. The contact module of claim 19 wherein said cavity comprises two edge walls, each of said edge walls having a shoulder in interfering mechanical relationship with said support sections of said contact.

29. The contact module of claim 28 wherein said support section comprises an elongate support arm extending generally in a direction about normal to the direction of deflection of said second contact section.

30. The contact module of claim 28 wherein said support section in contact with said shoulders comprises means for decoupling the first mating resistance of said first contact section from the second mating resistance of said second contact section.

* * * * *